US009260987B2

(12) United States Patent
Kim et al.

(10) Patent No.: US 9,260,987 B2
(45) Date of Patent: Feb. 16, 2016

(54) VARIABLE VALVE LIFT SYSTEM IN ENGINE AND CONTROL METHOD THEREOF

(71) Applicant: Hyundai Motor Company, Seoul (KR)

(72) Inventors: Hyoung Hyoun Kim, Gwangmyeong-si (KR); Jong Man Jun, Hwaseong-si (KR); Jong In Kang, Ulsan (KR); Seung Il Park, Suwon-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 0 days.

(21) Appl. No.: 14/308,578

(22) Filed: Jun. 18, 2014

(65) Prior Publication Data

US 2015/0369096 A1 Dec. 24, 2015

(51) Int. Cl.
*F01L 1/34* (2006.01)
*F01M 7/00* (2006.01)

(52) U.S. Cl.
CPC ..... *F01M 7/00* (2013.01)

(58) Field of Classification Search
CPC ..... F01M 7/00
USPC ..... 123/90.17, 90.33, 90.39, 90.16, 90.52, 123/90.59
See application file for complete search history.

(56) References Cited

U.S. PATENT DOCUMENTS

2003/0200944 A1* 10/2003 Takahashi et al. ..... 123/90.15
2008/0083389 A1* 4/2008 Hendriksma et al. ..... 123/90.33

FOREIGN PATENT DOCUMENTS

JP 08-177434 A 7/1996
JP 10-331616 A 12/1998
JP 2004-301101 A 10/2004
JP 2007-192112 A 8/2007

* cited by examiner

*Primary Examiner* — Zelalem Eshete
(74) *Attorney, Agent, or Firm* — McDermott Will & Emery LLP

(57) ABSTRACT

A variable valve lift (VVL) system in an engine includes an oil control valve and a lock pin configured to be hydraulically actuated against an elastic force of a return spring under a control of the OCV. An orifice through which oil passes is formed to supply hydraulic pressure to the OCV and the lock pin. An oil pressure sensor measures the hydraulic pressure to be supplied to the OCV and the lock pin. A controller is configured to receive a signal from the oil pressure sensor and to control the OCV according to the received signal.

4 Claims, 6 Drawing Sheets

VARIABLE VALVE LIFT SYSTEM IN ENGINE AND CONTROL METHOD THEREOF

TECHNICAL FIELD

The present disclosure relates, in general, to a variable valve lift (VVL) system in an engine, and more particularly, to a technology for controlling a hydraulic VVL mechanism using an oil control valve (OCV).

BACKGROUND

A conventional variable valve lift (VVL) mechanism to which the present disclosure is adapted is shown in FIGS. 1 and 2. The conventional VVL mechanism includes an inner arm 504 which has a rotatable roller 502 to come into contact with a low cam 500, causing a low lift action. A lost lever 510 covers the inner arm 504 and has a hinge shaft 506 as in the inner arm 504. The lost lever 510 is designed to come into contact with a high cam 508, causing a high lift action. A lock pin 512 moves back and forth in the inner arm 504 so as to switch an interlocked state between the lost lever 510 and the inner arm 504. A hydraulic lash adjuster (HLA) 515 is installed to support one side of the inner arm 504 and provides hydraulic pressure to the lock pin 512.

When an oil control valve (OCV) is turned on, the lock pin 512 is hydraulically actuated and extends outwards against an elastic force of a return spring 520 mounted in the inner arm 504. Thus, the lock pin 512 allows the lost lever 510 to move together with the inner arm 504 and increases a valve lift motion. When the OCV is turned off, the lock pin 512 is retracted into the inner arm 504 by the elastic force of the return spring 520 so as to nullify a movement of the lost lever 510, which affects the inner arm 504 The valve lift motion is relatively reduced by the inner arm 504 when the low cam 500 acts on the rotatable roller 502.

FIGS. 3 and 4 show on and off states, respectively, of a hydraulic circuit which includes an OCV 514 to actuate the lock pin 512. In the figures, when a solenoid of the OCV 514 is turned on, hydraulic pressure supplied from an oil gallery of a cylinder block is applied to the lock pin 512 so as to realize a high-lift state. In addition, when the OCV 514 is turned off, hydraulic pressure is not applied to the lock pin 512 so as to realize a low-lift state.

An orifice 516 in the hydraulic circuit secures a minimum hydraulic pressure in a deactivated state of the OCV 514 in order to maintain a function of the HLA 515 and to lubricate parts that are in contact with each other. The size of the orifice 516 is adjusted to secure the minimum hydraulic pressure.

However, the size of the orifice 516 cannot be actively regulated. Thus, if the size is relatively larger in order to secure a necessary minimum hydraulic pressure at a high-temperature idling state which is the least desirable hydraulic pressure-supplying state, a low-temperature middle-speed area which is the most desirable hydraulic pressure-supplying state essentially has a high hydraulic pressure even when the OCV 514 is in the off state.

In order to improve a problem of the high hydraulic pressure in the off state of the OCV 514, as shown in FIGS. 3 and 4, a relief valve 518 is additionally mounted to be connected to the hydraulic circuit only when the OCV 514 is in the off state so as to maintain a relatively low hydraulic pressure.

However, in very high-viscous oil conditions such as low temperatures including room temperature or when oil-degradation factors such as excessive soot in oil exist, oil discharge through the relief valve 518 is restricted. In these conditions, the lock pin 512 is inadvertently extended in the off state of the OCV 514, causing the high-lift state.

As conventional countermeasures for preventing such an inadvertent high-lift state, there is a method of increasing the elastic force of the return spring 520. However, it is difficult to switch to the high-lift state in the low-lift area, and the practical high-lift operation area is reduced, thus nullifying the application of the VVL.

The foregoing is intended merely to aid in the understanding of the background of the present disclosure, and is not intended to mean that the present disclosure falls within the purview of the related art that is already known to those skilled in the art.

SUMMARY

The present disclosure has been made keeping in mind the above problems occurring in the related art. An aspect of the present disclosure provides a variable valve lift (VVL) system in an engine, which, without abnormally increasing the elastic force of a return spring forcing a lock pin of a VVL mechanism to return to its original position, can prevent an inadvertent high-lift state even in very high-viscous oil conditions such as in low temperatures including room temperature, or when oil-degradation factors such as excessive soot in oil exist. The VVL system according to the present disclosure can ensure a stable, proper operation of the VVL mechanism throughout the entire operation area of the engine and can ensure a stable function of a hydraulic lash adjuster (HLA) and a smooth lubrication of parts that are in contact with each other, and a control method thereof.

According to an exemplary embodiment of the present inventive concept, a variable valve lift (VVL) system in an engine includes an oil control valve (OCV). A lock pin is configured to be hydraulically actuated against an elastic force of a return spring under a control of the OCV. An orifice through which oil passes is formed to supply hydraulic pressure to the OCV and the lock pin. An oil pressure sensor measures the hydraulic pressure to be supplied to the OCV and the lock pin. A controller is configured to receive a signal from the oil pressure sensor and to control the OCV according to the signal. The orifice has a size that is capable of securing a minimum hydraulic pressure necessary to implement a function of a hydraulic lash adjuster and lubrication of frictional parts in an operation area of the engine in which the hydraulic pressure is able to be supplied at a maximum rate. The controller is configured to turn on the OCV if a hydraulic pressure input from the oil pressure sensor does not reach a pressure level, such that when the hydraulic pressure is applied to the lock pin, the lock pin is able to overcome the elastic force of the return spring.

According to another exemplary embodiment of the inventive concept, a method of controlling a variable valve lift (VVL) system includes measuring an oil pressure to be supplied to an oil control valve (OCV) and a lock pin of a variable valve lift (VVL) mechanism. If the measured pressure of oil acting on the lock pin is lower than an elastic force of a return spring, the lock pin is elastically supported, and the OCV is forcedly turned on.

According to the present disclosure, the variable valve lift (VVL) system in the engine can prevent an inadvertent high-lift state even in very high-viscous oil conditions such as in low temperatures including a room temperature or when oil-degradation factors such as excessive soot in oil exist. The VVL system according to the present disclosure can ensure a stable, proper operation of the VVL mechanism throughout the entire operation area of the engine. Further, the VVL system according to the present disclosure can ensure a stable function of the hydraulic lash adjuster (HLA) and smooth lubrication of parts that are in contact with each other, without abnormally increasing the elastic force of the return spring forcing the lock pin of the VVL mechanism to return to its original position.

BRIEF DESCRIPTION OF THE DRAWINGS

The above and other objects, features and advantages of the present disclosure will be more clearly understood from the following detailed description when taken in conjunction with the accompanying drawings.

DETAILED DESCRIPTION

Hereinbelow, an exemplary embodiment of the inventive concept will be described in detail with reference to the accompanying drawings.

Figure 5:
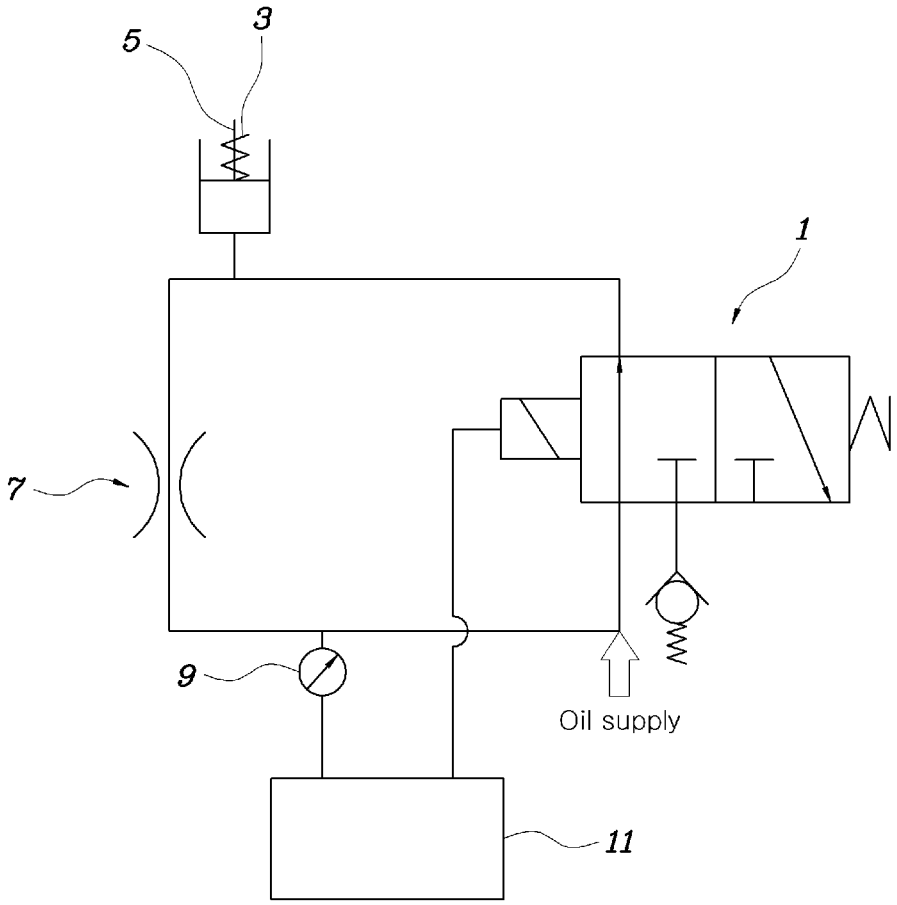
FIG. 5 is a view illustrating a variable valve lift (VVL) system in an engine according to an embodiment of the inventive concept.

Referring to FIG. 5, a variable valve lift (VVL) system in an engine according to the present disclosure includes an oil control valve (OCV) 1 and a lock pin 5 which is designed to be hydraulically actuated against an elastic force of a return spring 3 under a control of the OCV 1. An orifice 7 through which oil passes is formed so as to supply hydraulic pressure to the OCV 1 and the lock pin 5. An oil pressure sensor 9 measures the hydraulic pressure to be supplied to the OCV 1 and the lock pin 5. A controller 11 is configured to receive a signal from the oil pressure sensor 9 and controls the OCV 1 according to the received signal.

Figure 1:
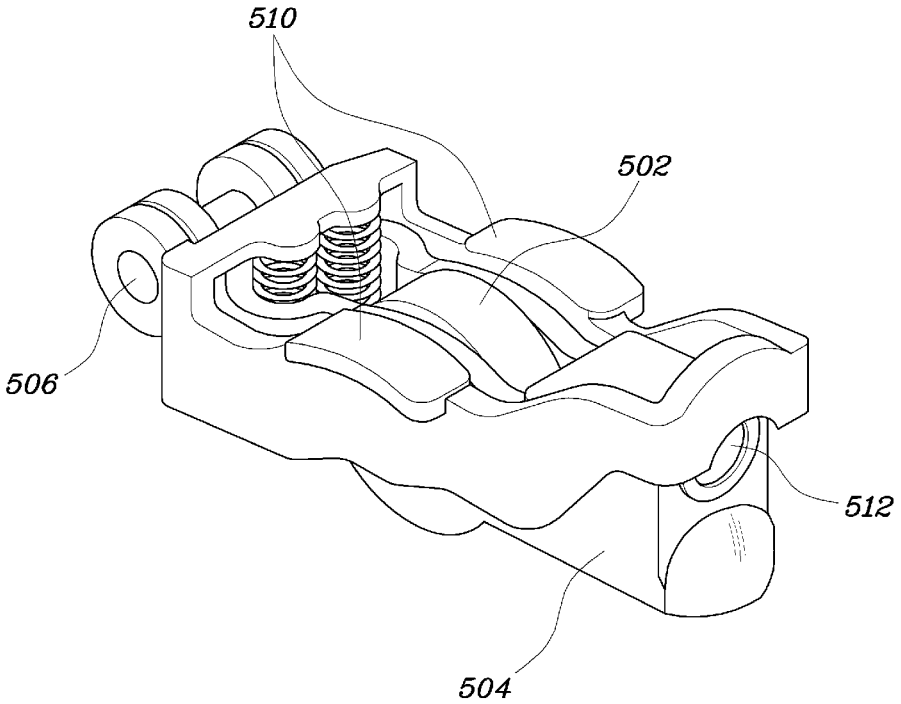
FIG. 1 (Related Art)
FIGS. 1 and 2 are views illustrating the structure of a conventional variable valve lift (VVL) mechanism to which the inventive concept is adapted.
Figure 2:
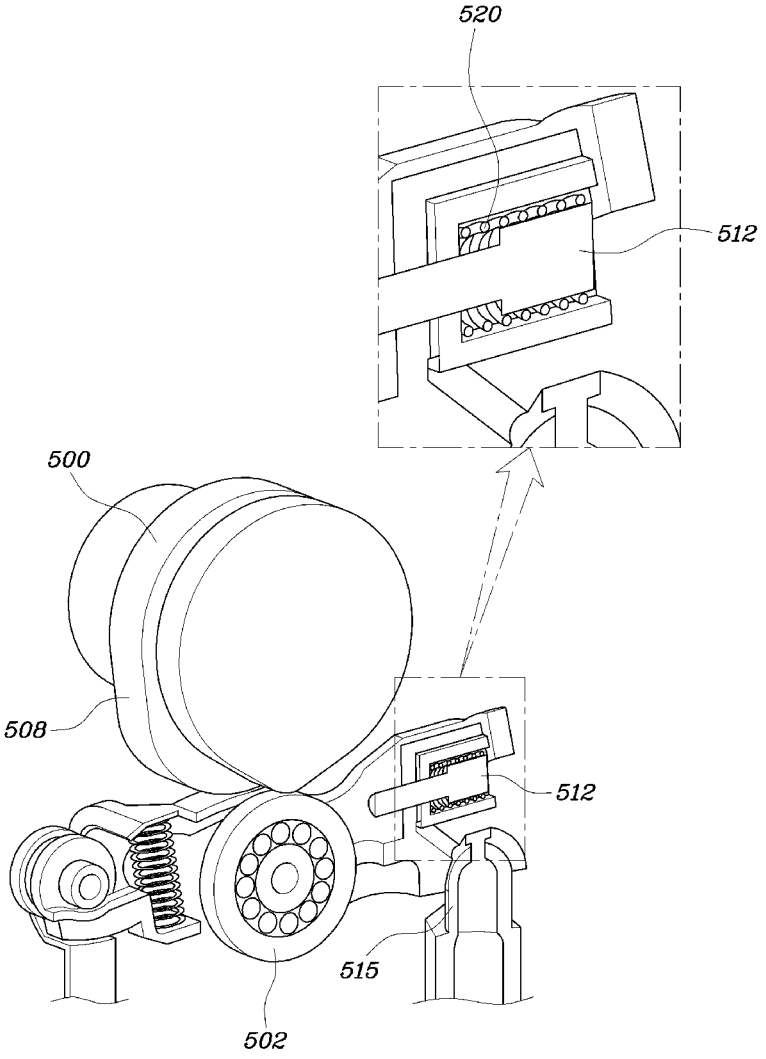
FIG. 2 (Related Art)
Figure 3:
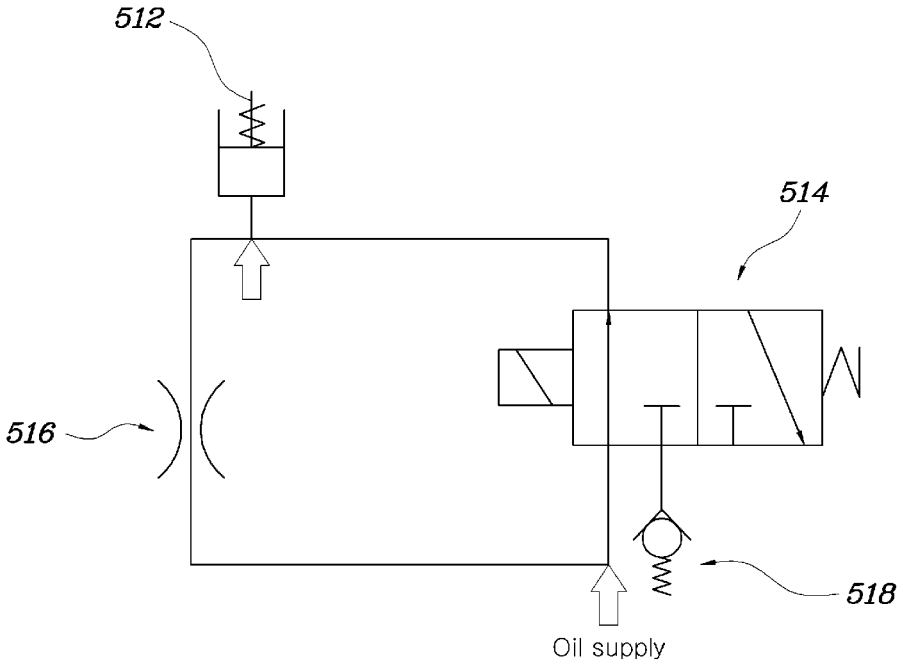
FIG. 3 (Related Art)
FIG. 3 is a view illustrating a hydraulic circuit of the conventional VVL system, showing that an oil control valve (OCV) is in an on state.
Figure 4:
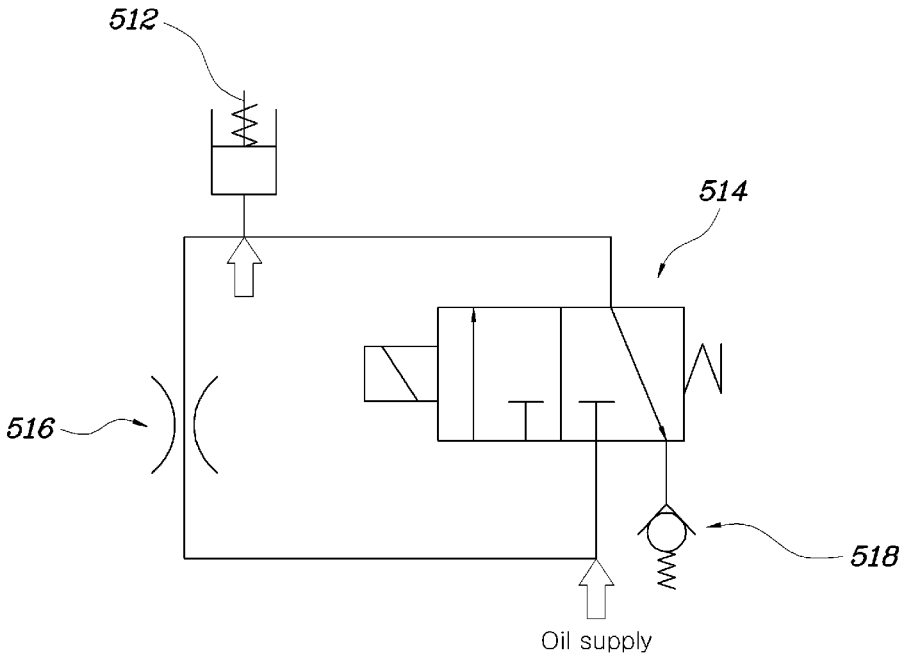
FIG. 4 (Related Art)
FIG. 4 is a view illustrating a hydraulic circuit of the conventional VVL system, showing that an oil control valve (OCV) is in an off state.

Here, the orifice 7 has a size that is capable of securing a minimum hydraulic pressure necessary to implement a function of a hydraulic lash adjuster ((HLA), refer to a reference numeral 515 in FIG. 2) and lubrication of frictional parts in an operation area of the engine in which hydraulic pressure supplies with a maximum rate. In addition, the controller 11 is configured to turn on the OCV 1 if a hydraulic pressure input from the oil pressure sensor 9 does not reach pressure level, such that when the hydraulic pressure is applied to the lock pin 5, the lock pin 5 overcomes the elastic force of the return spring 3.

That is, according to the present disclosure the size of the orifice 7 is reduced as compared to the conventional system such that the orifice can supply a minimum hydraulic pressure at the maximum rate. If the hydraulic pressure generated by an oil pump (not shown) and measured by the oil pressure sensor 9 is determined to be lower than the hydraulic pressure that can actuate the lock pin 5, the controller 11 turns the OCV 1 on so as to smoothly supply hydraulic pressure to the HLA and some frictional parts without actuating the lock pin 5.

Accordingly, without abnormally increasing the elastic force of the return spring 3 and forcing the lock pin 5 of the VVL mechanism to return to its original position, the variable valve lift (VVL) system in the engine can prevent an inadvertent high-lift state even in very high-viscous oil conditions such as low temperatures including room temperature by when oil-degradation factors such as excessive soot in oil exist. The VVL system according to the present disclosure can ensure a stable, proper operation of the VVL mechanism throughout the entire operation area of the engine. Further, the VVL system according to the present disclosure can ensure a stable function of the HLA and smooth lubrication of frictional parts, thereby securing a sufficient operation area of the VVL mechanism and improving the durability of the HLA.

The operation area of the engine in which hydraulic pressure can be supplied at the maximum rate belongs to a low-temperature middle-speed area of the engine in which the engine operates at a sufficiently low temperature and a middle speed so that the engine does not need a relatively high supply of oil and an oil pump operating in association with the engine operates at a rate sufficient to pump a necessary amount of oil.

Figure 6:
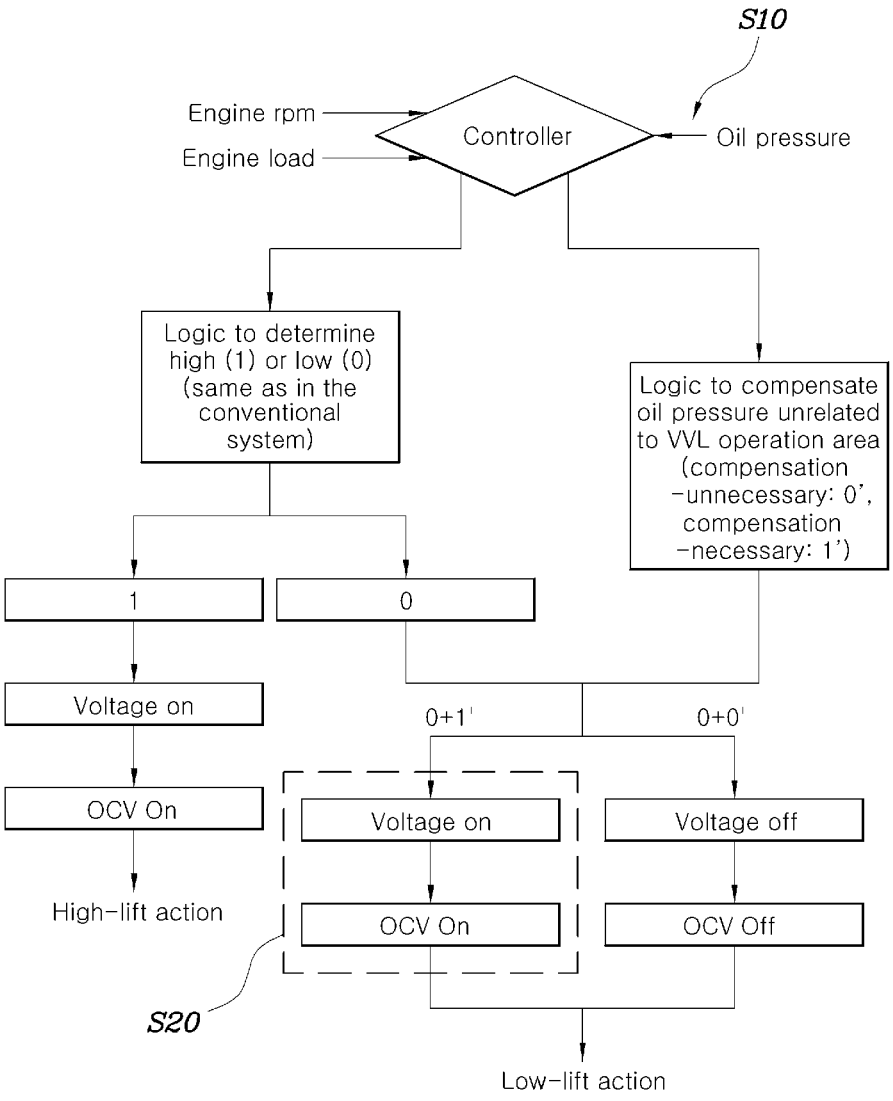
FIG. 6 is a view illustrating a flow chart of a control method of a VVL system according to an embodiment of the inventive concept.

Referring to FIG. 6, the present disclosure provides a method of controlling a variable valve lift (VVL) system. The method includes a measuring pressure of oil to be supplied to the oil control valve (OCV) 1 and the lock pin 5 of a variable valve lift (VVL) mechanism (S10). As a result of the step S10, if the measured pressure of oil acting on the lock pin 5 is lower than an elastic force of the return spring 3 which elastically supports the lock pin 5, the OCV 1 is forcedly turned on (S20).

That is, in a normal state, after receiving an engine revolution per minute (RPM) and an engine load and accordingly determining a VVL operation area for each engine operation area, if a high-lift valve action is necessary, the controller 11 turns the OCV 1 on If a low-lift valve action is necessary, the controller turns the OCV 1 off. In addition, if a force applied to the lock pin 5 by hydraulic pressure measured by the oil pressure sensor 9 is lower than the elastic force of the return spring 3, the controller turns the OCV 1 on so as to supply a sufficient hydraulic pressure to parts such as an HLA and the like.

That is, in the step S20, the controller 11 independently controls the OCV 1 irrespective of the engine rpm or the engine load, such that the sufficient hydraulic pressure can be supplied to the HLA and the like under situations in which an oil supply may not be sufficient only with the orifice 7.

Although an exemplary embodiment of the inventive concept has been described for illustrative purposes, those skilled in the art will appreciate that various modifications, additions, and substitutions are possible, without departing from the scope and spirit of the invention as disclosed in the accompanying claims.

What is claimed is:

1. A variable valve lift (VVL) system in an engine, including:

an oil control valve (OCV);

a lock pin configured to be hydraulically actuated against an elastic force of a return spring under a control of the OCV;

an orifice through which an oil passes to supply a hydraulic pressure to the OCV and the lock pin;

an oil pressure sensor measuring the hydraulic pressure to be supplied to the OCV and the lock pin; and a controller configured to receive a signal from the oil pressure sensor and control the OCV according to the received signal, wherein the orifice has a size that is capable of securing a minimum hydraulic pressure necessary to implement a hydraulic lash adjuster function and lubrication of frictional parts in an operation area of the engine in which the hydraulic pressure is able to be supplied at a maximum rate, wherein the controller is configured to turn on the OCV when the measured hydraulic pressure received from the oil pressure sensor does not reach a pressure level such that the hydraulic pressure is applied to the lock pin, the lock pin is able to overcome the elastic force of the return spring, and wherein the controller is further configured to forcedly turn on the OCV when the measured hydraulic pressure acting on the lock pin is lower than the elastic force of the return spring which elastically supports the lock pin.

2. The VVL system according to claim 1, wherein the operation area in the engine in which the hydraulic pressure is able to be supplied at the maximum rate belongs to a low-temperature middle-speed area of the engine in which the engine operates at a sufficiently low temperature and a middle speed so that the engine does not need a relatively high oil supply, and an oil pump operating in association with the engine operates at a rate sufficient to pump a necessary amount of oil.

3. A method of controlling a variable valve lift (VVL) system, including steps of:

measuring a hydraulic pressure to be supplied to an OCV and a lock pin of a VVL mechanism; and forcedly turning on the OCV if the measured hydraulic pressure acting on the lock pin is lower than the elastic force of a return spring which elastically supports the lock pin.

4. The method according to claim 3, wherein in the step of turning on the OCV, the OCV is independently controlled irrespective of an engine revolution per minute (RPM) or an engine load.

* * * * *